United States Patent [19]

Meek

[11] 4,270,301

[45] Jun. 2, 1981

[54] MODEL AIRPLANE AND BLANK THEREFORE

[76] Inventor: Donald J. Meek, 3503 Hanks St., Sacramento, Calif. 95826

[21] Appl. No.: 5,577

[22] Filed: Jan. 22, 1979

[51] Int. Cl.[3] ..... A63H 27/02

[52] U.S. Cl. ..... 46/1 L; 46/79

[58] Field of Search ..... 46/1 L, 21, 24, 76 R, 46/78, 79, 23, 32, 157, 76 A, 77

[56] References Cited

U.S. PATENT DOCUMENTS

| | | | |
|---|---|---|---|
| 1,818,426 | 8/1931 | Norcross | 46/79 |
| 2,005,842 | 6/1935 | Marcus | 46/76 R |
| 2,303,632 | 12/1942 | Grant | 46/76 R |
| 2,396,886 | 3/1946 | Rossiter | 46/76 R |
| 2,397,364 | 3/1946 | Myers | 46/76 R |
| 2,637,139 | 5/1953 | Harris | 46/76 R X |
| 2,870,568 | 1/1959 | Bergstrand | 46/76 R |
| 3,858,349 | 1/1975 | McClendon | 46/76 R |

*Primary Examiner*—F. Barry Shay

*Attorney, Agent, or Firm*—Blair, Brown & Kreten

[57] ABSTRACT

Disclosed herein is a blank for making model airplanes and the article thus formed characterized in that the empennage and forward wing structure reflect a greater degree of authenticity and fidelity to true airplanes in that positive and negative dihedral are capable of being reflected therein, and further camber is possible for these plane sections as well.

1 Claim, 11 Drawing Figures

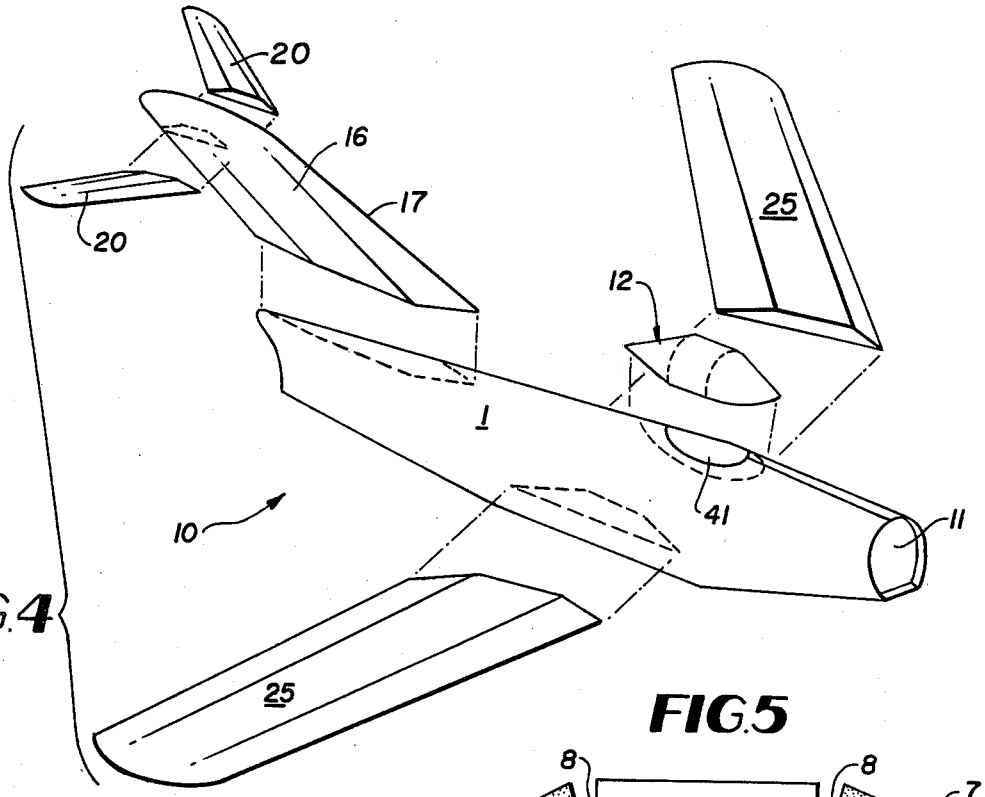
FIG.4
FIG.5
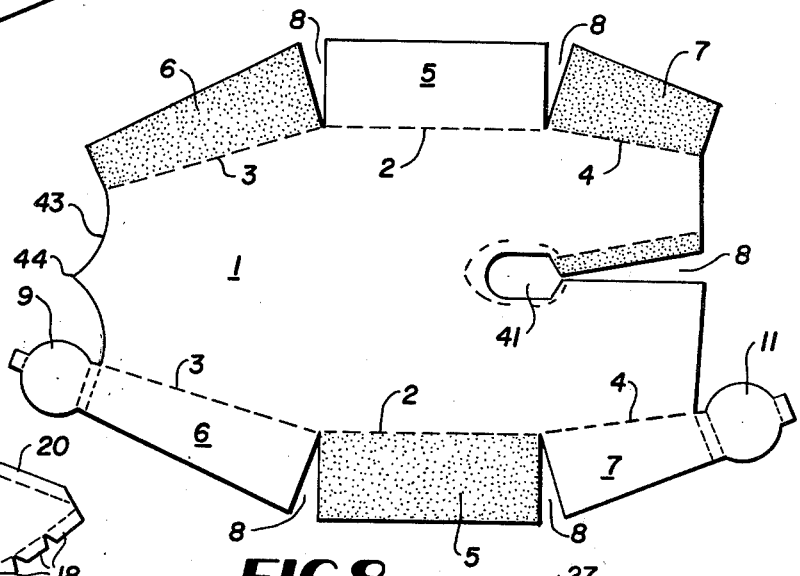
FIG.6
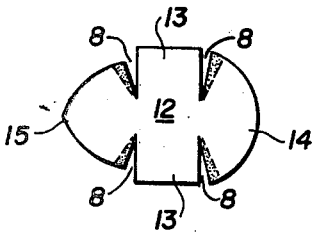
FIG.7
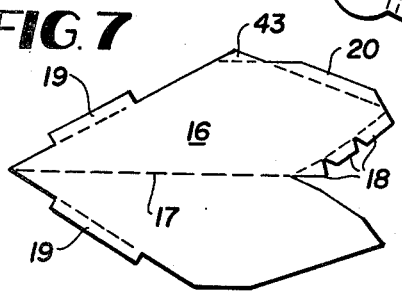
FIG.8
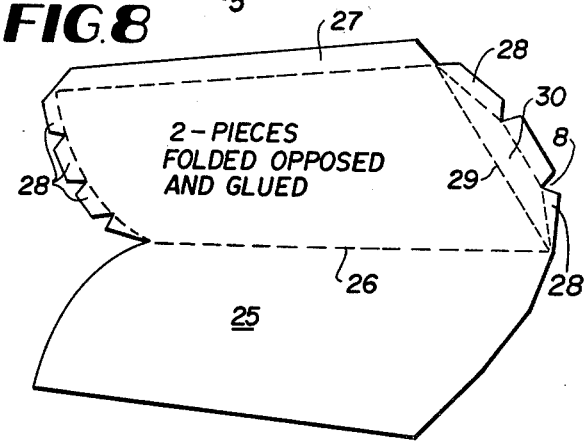
FIG.9
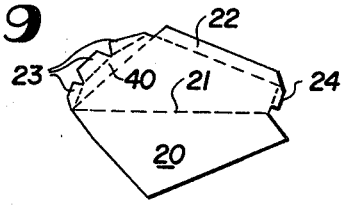
2-PIECES FOLDED
OPPOSED AND GLUED

MODEL AIRPLANE AND BLANK THEREFORE

BACKGROUND OF THE INVENTION

Model and toy airplanes have been known to exist for some time in the prior art, and those prior art patents which appear to be most relevant to the instant application comprise the following list:

U.S. Pat. No. 2,005,842, Marcus
U.S. Pat. No. 2,397,364, Myers
U.S. Pat. No. 2,303,632, Grant
U.S. Pat. No. 2,637,139, Harris
U.S. Pat. No. 2,396,886, Rossiter
U.S. Pat. No. 3,858,349, McClendon It is to be noted by perusing these above reference patents, that they all share at least one or more of the following defects when contrasted with the instant application; lack of realism, lack of dihedral for the front wings and empennage and the means for adjusting this dihedral, the provision of the provision of camber and a resulting structure sufficiently light that it may be suspended from a ceiling by means of a thread, or alternatively may be placed on a base member formed from a blank integral with the model and displayed thereon.

SUMMARY OF THE INVENTION

Accordingly, the ensuing application directs itself to a model airplane and blank for forming same which allays the above noted deficiencies common to the prior art.

Specifically an aspect of this invention contemplates providing horizontal wing sections capable of being provided with dihedral.

A further object contemplates providing an empennage area and wing structure in which the camber of the surfaces can be varied to display cambers of various dimensions thereon.

A further object of this invention contemplates providing a blank for forming a model airplane which when constructed provides a model which is sufficiently light to be suspended by a thread, or alternatively can be provided on a base integral with the kit.

A further object contemplates providing a model kit which is easy to fabricate and realistic in appearance, whereby the color of the plane, associated decals, distinctive markings, etc. are integral with the blank thereby obviating the necessity of painting the model.

These and other objects will be made manifest when considering the following detailed specification and drawings.

BRIEF DESCRIPTION OF THE DRAWINGS

FIG. 4 is an exploded parts view of the components that form the model aircraft according to the present invention;

FIG. 5 is an exploded unfolded view of the blank which when properly manipulated becomes the fuselage;

FIG. 6 shows the blank which forms the canopy;

FIG. 7 shows the vertical stabilizer of the empennage in its unfolded state;

FIG. 8 shows the forward horizontal wings;

FIG. 9 shows the rear horizontal stabilizer associated with the empennage;

BRIEF DESCRIPTION OF THE PREFERRED EMBODIMENT

Figure 1:
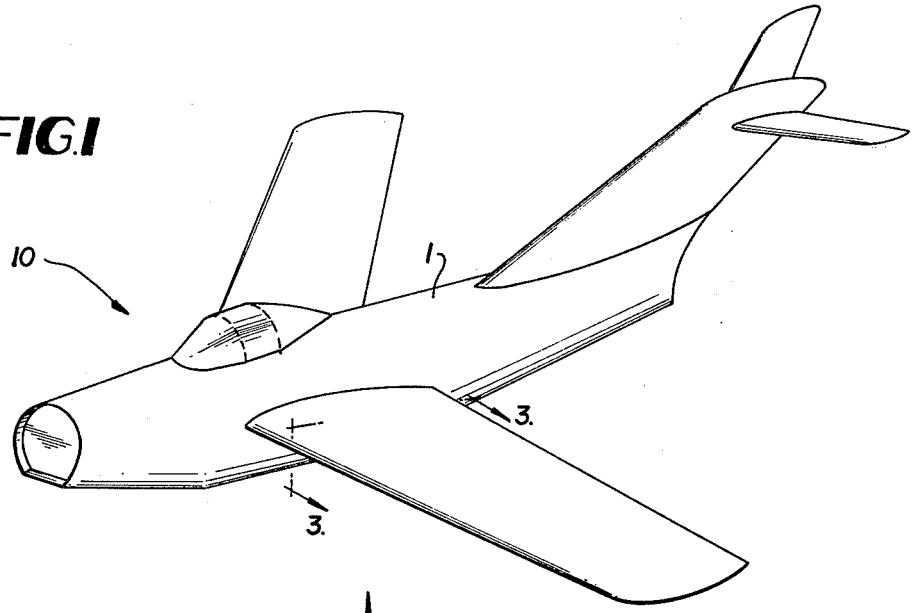
FIG. 1 provides an isometic view of the model in its completed form.

Referring to the drawings now, wherein like reference numerals refer to like parts throughout the several drawings, reference numeral 10 is directed to the model airplane according to the present invention when in its finished form.

Figure 2:
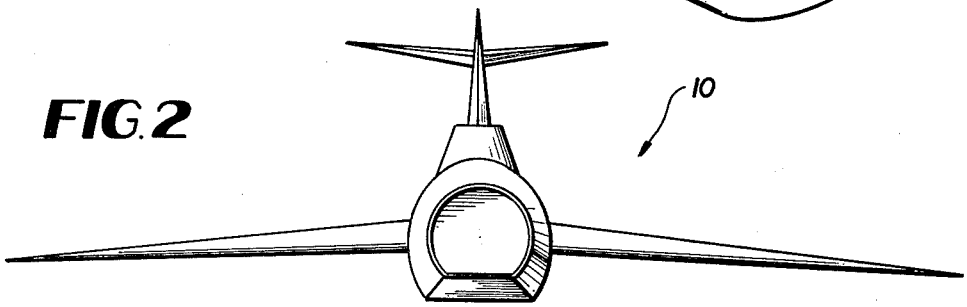
FIG. 2 is a front view thereof.

It is believed by describing first the blank associated with the model and the technique used for assembling same, the resulting structure when associated with the airplanes of FIGS. 1, 2 and 4 will be apparent.

The fuselage 1 is shown in FIG. 5 as having an axis of symmetry along points 44-41, in which the vertical mid-portion of the fuselage is slightly more bulbous than the ends, and the forward section curves at a slightly less severe angle than the rearward section. The main portion of the body is defined by the score lines 2, 3 and 4, and outside this scored area, tabs 5, 6 and 7 are disposed on opposed ends thereof, and the stippling disposed on these tabs defines an area of registry in which these strippled portions are caused to underlie and fastened by adhesive to the other tab portion. A plurality of V-shaped notches are disposed between each of these tabs and also along the front end of the fuselage extending to the cockpit area 41. The stippled area proximate to the cockpit 41 indicates that this small portion underlies a complemental area on the other side of the notch 8. The front and rear sections are provided with a simulated air intake and exhaust, reference numerals 9 and 11 respectively as used in a jet engine, and when rolled up, the fuselage will define a configuration of its front and rear extremities thereof so that these disc like members 11 and 9 can be glued therein.

The canopy is shown in FIG. 6 as defining a somewhat ovaloid or egg-shaped configuration when disposed in a plane, with the front portion 15 having a different radius of curvature than the rear portion 14. A plurality of notch like voids 8 are also provided to allow the middle section and front and rear sections 13, 15 and 14 respectively to be assembled so as to provide the completed canopy 12 as shown in FIG. 4. Again the stippled area indicates a tab portion which is caused to underlie a corresponding portion proximate thereto to provide an adhesive bonding. Reference numerals 14 and 15 define the front and rearward portions of the canopy and constitute an axis of symmetry.

FIG. 7 depicts the vertical stabilizer 16, and the score line 17 defines the axis of symmetry for the upper and lower portions whih when excluding tabs 19, 20 and 18 define a substantially rhomboid structure. The vertical stabilizer 16 is folded along the score line 17, and the two tabs 19 are affixed in such a manner that the sides opposed from the score line 17 have an arcuate shape which thereafter is fastened in that configuration by bending over the tabs 18 and 20 and 43 using a suitable adhesive. Reference numeral 17 defines the leading edge of the vertical stabilizer, the terminal portion or score line proximate to reference numeral 20 is a trailing edge, and the end nearest and contiguous with 19 defines the root portion which is affixed to the fuselage.

FIG. 8 shows the forward wing section 25 in which the score lines 26 define the leading edge of the wind when such is assembled correctly, and a plurality of tabs 28 define the fastening elements which glue the upper and lower halves of the wing at the extremity remote from the fuselage, while the area which has a terminal portion further provided with tabs 28 define the root face 30 in which the wing is fastened to the fuselage, and marginal portion 27 of the blank provides a lip which affixes the top and bottom wing sections opposite from the scored line 26. It should be noted that the top portion of the wing has a greater surface area than the bottom so that the top portion is caused to be provided with an arcuate configuration as shown by the root 30 whereby a model plane can be provided with a realistic appearance of camber, and the configuration of the root face 30 can be angulated to provide for dihedral. More specifically, with reference to FIG. 8, if the length of top section 25 of the wing is shorter than the bottom section 25 then a positive dihedral results. If the length of the bottom section 25 is shorter than the top top section 25, a negative dihedral results.

Figure 3:
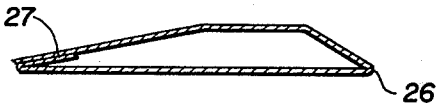
FIG. 3 is a sectional view taken along lines 3—3 of FIG. 1.

FIG. 9 shows the horizontal stabilizers associated with the rear wing empennage, and similar to the front wing sections is provided with a central score line 21, a marginal portion 22, a plurality of tabs 23 and 24 and a root affixing area 40 substantially for the same purpose. That is, the top portion of the wing has an arcuate configuration, to provide camber; and further the root area 40 can be varied so as to provide positive or negative dihedral as desired. FIG. 3 shows in cross section the camber effect of the forward most wing, but it should be appreciated that the same would apply for the empennage horizontal stabilizer as well.

Figure 10:
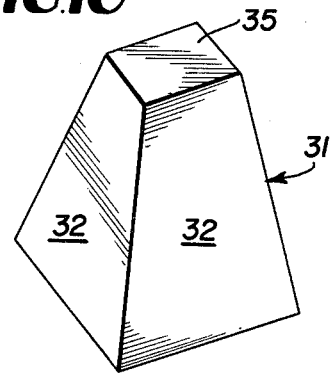
FIG. 10 shows the base integral with the kit in its completed state.
Figure 11:
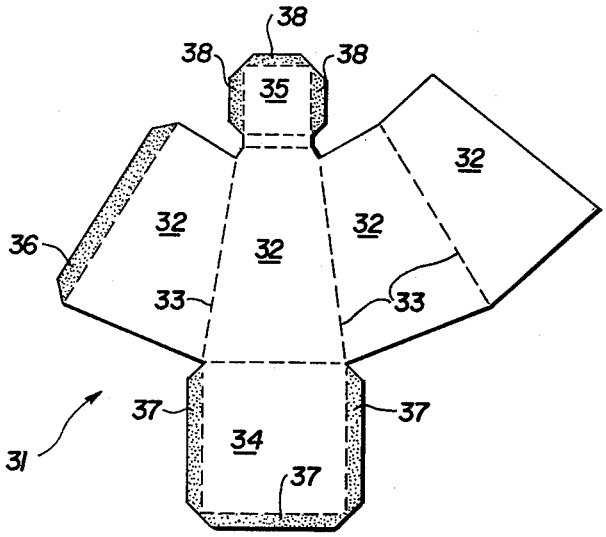
FIG. 11 is an exploded unfolded blank showing the base in its unassembled condition.

FIG. 10 shows a pedestal 31 upon which the plane can be mounted. FIG. 11 depicts the blank from which the pedestal is to be made. The pedestal is provided with side members 32 each having a truncated triangular configuration scored along lines 33 and placed in registry therealong so that the four sides 32 provide a contiguous array and one end thereof terminates in a marginal area 36 which affixes the opposed and further most disposed side 32 when folded. The base 34 is provided with three marginal portions 37 and a score line which extends upwardly within the wall segments and is affixed thereto as by an adhesive so that the pedestal is securely affixed, and the top portion 35 is similarily provided with a marginal area 38 whose purposes parallel that of portions 37.

Having thus described the invention it should be apparent that the blank and configurations thus described lend themselves to be provided with indicia disposed thereon which would obviate the necessity of painting a model thus fabricated, and it is of minimal weight, while still preserving the realism associated with a model according to the present invention. Further it should be apparent that numerous structural modifications are contemplated as being a part of this invention as set forth hereinabove and as defined in the claims.

What is claimed is:

1. The blanks for constructing a model airplane to be formed entirely from preprinted flat sheet material that serves as patterns and also as skin structure of the parts of the airplane comprising in combination:

a fuselage blank having score lines outlining a widened central portion, an inwardly tapering leading portion, and an inwardly tapering trailing portion in which the severity of the taper is greater for the trailing end of the fuselage blank, tab members joined to said fuselage blank along said score lines at opposed lateral extremities of said fuselage blank, whereby when said fuselage blank is rolled, and opposed ones said tab portions placed in registry and mutually affixed, said fuselage is thereby formed, pairs of wing blanks adapted to form forward and rearward wings, each said wing blank comprising: two panels separated by a score line adapted to define the leading edge of the completed wing, a first of said panels being adapted to form a top wing surface and having a greater area than the second panel so as to provide an arcuate camber on the wing then folded along said score line, a marginal portion at the extremity of said second panel remote from the leading edge score line, a second score line associated with said marginal portion which, in the completed wing, locates a trailing edge of said wing about which said marginal portion may be folded whereby said marginal portion can fasten to the first panel, a face portion at an end of said wing blank extending between termini of said first and second score lines for forming a root face to be used in adhering said wing to the airplane, said first and second panels having different lengths as measured from the wing blank portion that is adapted to form the wing tip to said root face portion so as to provide dihedral to the wing.

* * * * *